US008622531B1

(12) United States Patent
Hochreiter et al.

(10) Patent No.: US 8,622,531 B1
(45) Date of Patent: Jan. 7, 2014

(54) INK TANK HAVING A SINGLE GASKET

(75) Inventors: Eric Peschan Hochreiter, Rochester, NY (US); Donald Steven Hensel, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/615,939

(22) Filed: Sep. 14, 2012

(51) Int. Cl.
*B41J 2/175* (2006.01)

(52) U.S. Cl.
USPC ..... 347/86

(58) Field of Classification Search
USPC ..... 347/85, 86, 87, 93
See application file for complete search history.

(56) References Cited

U.S. PATENT DOCUMENTS

| | | | | |
|---|---|---|---|---|
| 5,877,794 | A * | 3/1999 | Takagi | 347/87 |
| 5,949,458 | A * | 9/1999 | Studholme | 347/86 |
| 6,234,619 | B1 * | 5/2001 | Kiritake | 347/87 |
| 6,290,345 | B1 * | 9/2001 | Sasaki et al. | 347/86 |
| 6,761,441 | B2 * | 7/2004 | Lui | 347/86 |
| 6,834,945 | B2 * | 12/2004 | Ishizawa et al. | 347/86 |
| 7,905,572 | B2 * | 3/2011 | Anderson et al. | 347/49 |
| 8,052,267 | B2 | 11/2011 | Amesbury | |
| 8,066,363 | B2 | 11/2011 | Greer et al. | |

* cited by examiner

*Primary Examiner* — Anh T. N. Vo
(74) *Attorney, Agent, or Firm* — Peyton C. Watkins

(57) ABSTRACT

An ink tank includes a free-ink chamber; an ink supply port extending from the tank body, which ink supply port permits passage of ink from the free-ink chamber; a filter disposed in the ink supply port and having a first surface facing the free-ink chamber and a second surface opposite the first surface; a wick disposed in the ink supply port adjacent to the second surface of the filter and downstream of the filter; and a single gasket disposed in the ink supply port adjacent to and downstream of the wick.

16 Claims, 7 Drawing Sheets

INK TANK HAVING A SINGLE GASKET

FIELD OF THE INVENTION

The present invention generally relates to free-ink tanks for off-axis printers and more particularly to passing ink from the free-ink tank to the printhead using a select arrangement of a filter, wick and a single gasket.

BACKGROUND OF THE INVENTION

Inkjet printing systems can be either an on-axis or off-axis printer. In on-axis printing, printheads include inlet ports for receiving ink from one or more ink tanks. The printhead includes arrays of drop ejectors that receive the ink from the inlet ports and that are controlled to make marks of particular sizes, colors, or densities in particular locations on the recording medium in order to print the desired image. In some types of inkjet printing systems the array(s) of dot forming elements extends across the width of the page, and the image can be printed one line at a time, as the recording medium is moved relative to the printhead. Alternatively, in a carriage printing system (whether for desktop printers, large area plotters, etc.) the printhead or printheads are mounted on a carriage that is moved past the recording medium in a carriage scan direction as the dot forming elements are actuated to make a swath of dots. At the end of the swath, the carriage is stopped, printing is temporarily halted and the recording medium is advanced. Then another swath is printed, so that the image is formed swath by swath.

An inkjet drop ejector includes a nozzle and a drop forming mechanism (such as a resistive heater for thermal inkjet, or a piezoelectric device for piezoelectric inkjet) in order to generate pressure within an ink-filled chamber and eject ink from the nozzle. In page-width inkjet printers, as well as in carriage inkjet printers, the printhead and the recording medium are moved relative to one another as drops are ejected in order to form the image.

An ink supply can be permanently attached to a printhead, or an ink supply can be replace-ably connected to and disconnected from a printhead. Unlike printheads having permanently attached ink supplies, the printhead having replaceable ink tanks does not need to be discarded for a replaceable ink supply when the ink supply is depleted, so the running costs of the printer are lower for replaceable ink supplies. Ink tanks containing ink are installed into the printhead for supplying the ink needed for printing. Some types of ink tanks include an outlet port having a flange that contains a wick for permitting ink to pass to an inlet port of the printhead by capillary action. The inks tanks are manually mounted into a holding receptacle of the printhead by a pivoting, inwardly and downwardly manual force of the user. Some types of printhead include a flat gasket located on a floor of the holding receptacle, and a bottom of the flange of the outlet port of the ink tank is forced against the flat gasket when the ink tank is installed. Although such a sealing configuration works well in many applications, in some applications sealing against a flat gasket on the floor of the holding receptacle can require excessive installation force.

In an off-axis printing system, the printhead is substantially similar except that there is a primary ink supply and a secondary ink supply that are connected for supplying the ink for printing. The primary ink supply is rigidly mounted on the printer so that it remains stationary, and a secondary ink supply is mounted on the carriage. Ink is transferred from the primary ink supply to the secondary ink supply as needed. In this way, the amount of ink that is moved by the carriage is kept low (so that forces during carriage acceleration and deceleration can be acceptably low) and the user does not need to replace the ink very frequently.

To refill the secondary ink supply from the primary ink supply, flexible tubing is used, or alternatively the secondary ink supply can be moved near the primary ink supply on an as-needed basis and ink can be transferred to the secondary ink supply. Similar to the on-axis ink tanks, some types of secondary ink supplies include an outlet port having a flange that contains a wick that facilitates ink transfer to the printhead. A replaceable secondary ink supply for an off-axis printing system will be referred to herein as an ink tank, i.e. the same terminology used for the replaceable ink supply for an on-axis printing system.

In both on-axis and off-axis printing systems having replaceable ink supplies, the ink tanks (secondary ink supply for the off-axis) need to be installed. In both cases and particularly for the off-axis printing system, the ink tank can even be removed and replaced for maintenance.

U.S. Pat. No. 8,066,363 discloses an apparatus for securing an ink tank into a printhead. FIGS. 4a and 4b of U.S. Pat. No. 8,066,363 disclose three single gaskets 34, 45 and 47 and a retainer 30 among other things for securing the ink tank into the printhead. It is readily apparent that this apparatus is complex in design and is prone to failure due to the numerous interconnecting parts.

Consequently, a need exists for securing an ink tank to a printhead with low installation force by an apparatus that is simple in design and reliable over time. The present invention provides such an ink tank that meets this need.

SUMMARY OF THE INVENTION

The present invention is directed to overcoming one or more of the problems set forth above. Briefly summarized, according to one aspect of the invention, the invention resides in an ink tank comprising: a free-ink chamber; an ink supply port extending from the tank body, which ink supply port permits passage of ink from the free-ink chamber; a filter disposed in the ink supply port and having a first surface facing the free-ink chamber and a second surface opposite the first surface; a wick disposed in the ink supply port adjacent to the second surface of the filter and downstream of the filter; and a single gasket disposed in the ink supply port adjacent to and downstream of the wick.

These and other objects, features, and advantages of the present invention will become apparent to those skilled in the art upon a reading of the following detailed description when taken in conjunction with the drawings wherein there is shown and described an illustrative embodiment of the invention.

ADVANTAGEOUS EFFECT OF THE INVENTION

The present invention has the advantages of low installation force of the ink tank or secondary ink supply, using a seal that is simple in design and reliable over time.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Before turning to the drawings, a brief definition of some of the terms used herein will be defined. As used herein, "downstream" means in the direction of fluid flow (ink in the present invention) and "upstream" means in the direction opposite of the fluid flow.

Figure 1:
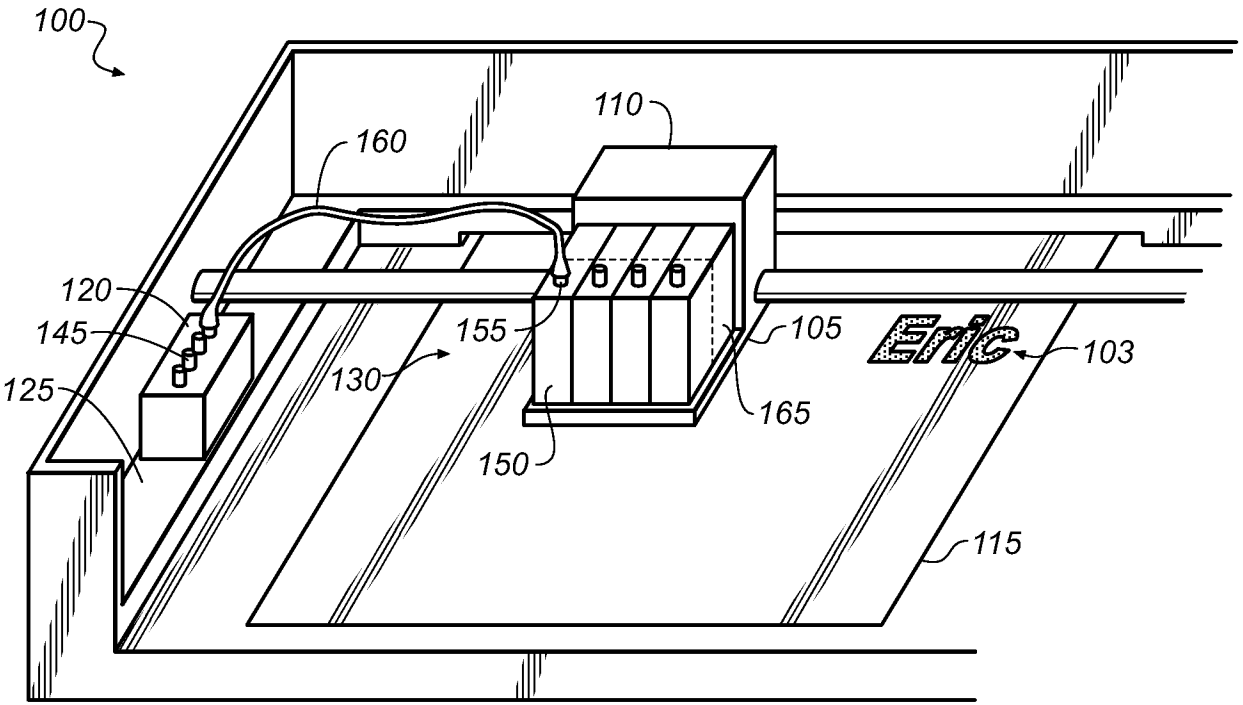
FIG. 1 is a perspective of an interior portion of an off-axis printer.

FIG. 1 is a perspective of an interior portion of an off-axis printer 100 according to an embodiment of the present invention. Although ink is shown in the preferred embodiment, any liquid is suitable for the present invention. An inkjet printhead 105 is disposed on a carriage 110 and includes at least one nozzle array (not visible from the view of FIG. 1) which directs ink droplets onto a recording medium 115. A primary ink supply 120 is rigidly mounted on a support base 125. The carriage 110 moves the inkjet printhead 105 back and forth across a print region 130 so that an image (such as letters "Eric" 103) can be printed on the recording medium 115. At least one pressure-regulated secondary ink supply 150 is mounted on the inkjet printhead 105 which moves in conjunction with the printhead 105. In this embodiment of FIG. 1, the primary ink supply 120 includes four ink sources, each having a tubing connector 145, although the number of ink sources can vary depending on the particular design. The tubing connectors 145 extend inside the primary ink supplies 120 and can extend substantially to the bottom of primary ink supply 120 so that ink can continue to be withdrawn as it is depleted. Alternatively, in other configurations (not shown) tubing connectors 145 can be located near the bottom of primary ink supply 120, preferably when the primary ink supply 120 is located above a secondary ink supply 150 permitting gravity to transport the fluid. In the example of FIG. 1, a pump (not shown) is enclosed within the primary ink supply 120 for pumping the ink since the location of the primary ink supply 120 (at or below the elevation of its destination, secondary ink supplies 150) does not lend itself to gravitational flow.

Four secondary ink supplies 150 (e.g. cyan, magenta, yellow and black inks) each include a conduit 155 and are mounted on the carriage 110 via the inkjet printhead 105 for supplying ink to the inkjet printhead 105 so that the carriage 110 moves the secondary ink supplies 150 as well as the inkjet printhead 105. As ink is used during printing and maintenance processes, ink is passed from the primary ink supply 120 through a flexible tubing 160, to the conduit 155 and eventually into the secondary ink supplies 150 for replenishing the secondary ink supplies 150. It is noted for clarity that only one piece of the flexible tubing 160 is shown in FIG. 1 so as not to obscure other features. Secondary ink supplies 150 can be provided as discrete ink supplies, or two or more ink supplies can be bundled together as a multi-chamber ink tank. Secondary ink supplies 150 are preferably free-ink tanks, which means an interior portion of the free-ink tank contains only ink and is free of any absorbent material that functions to control flow as is well understood in the art.

A pressure regulator 165 is disposed extending into the secondary ink supply 150 for regulating the ink back pressure required by the ejector nozzles and in particular for damping out pressure spikes that occur as the carriage 110 is moved back and forth during printing.

Figure 2:
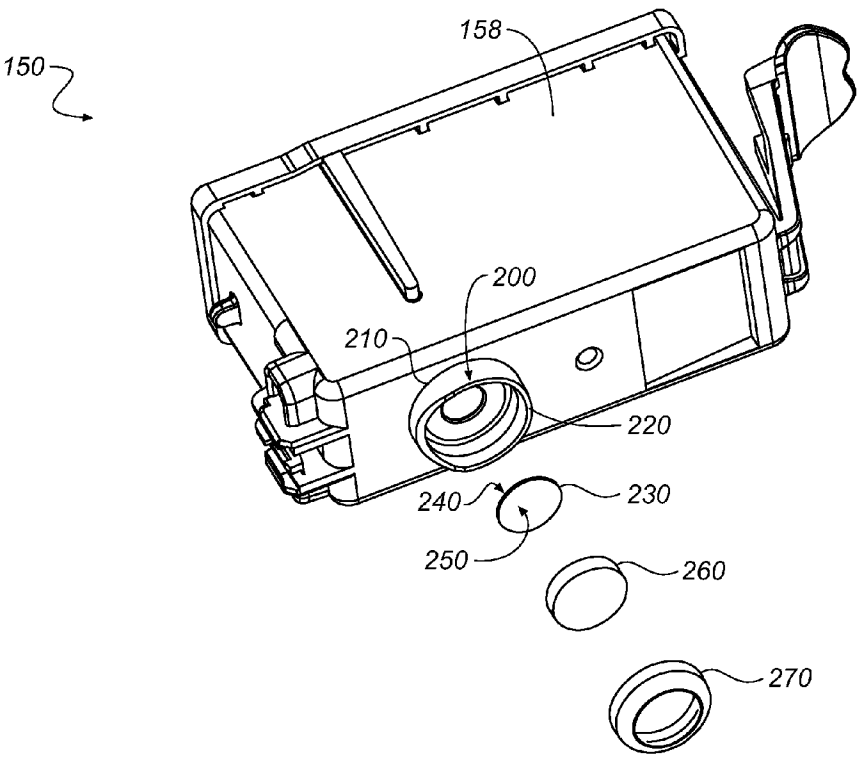
FIG. 2 is a perspective of a free ink tank of the present invention having several components shown in their non-installed state.

Referring to FIG. 2, there is shown a perspective view of a free-ink tank of the present invention. The free-ink tank 150 includes a free-ink chamber 158 for holding ink and an ink supply port 200 having a free-ink chamber end 210 extending from the free-ink chamber 158 and an outlet end 220 opposite the free-ink chamber end 210. The ink supply port 200 permits passage of ink from the free-ink chamber 158. A filter 230 is disposed in the ink supply port 200 and having a first surface 240 facing the free-ink chamber 158 when installed in the ink supply port 200 and a second surface 250 opposite the first surface and facing downstream. A wick 260 is disposed in the ink supply port 200 adjacent to the second surface 250 of the filter 230 and downstream of the filter 230. A single gasket 270 is disposed in the ink supply port 200 adjacent to and downstream of the wick 260. As used herein, "single" is used as commonly understood which is only one gasket, which is not in association or in combination with another gasket. It is noted for clarity that this is distinct from U.S. Pat. No. 8,066,363 which uses three individual interconnected gaskets and a retainer, which retainer the present invention does not include or need. The filter 230 is preferably a porous material that permits ink to flow there-through in a regulated manner and is preferably stainless steel having a plurality of holes or pores that permit ink flow.

Figure 3:
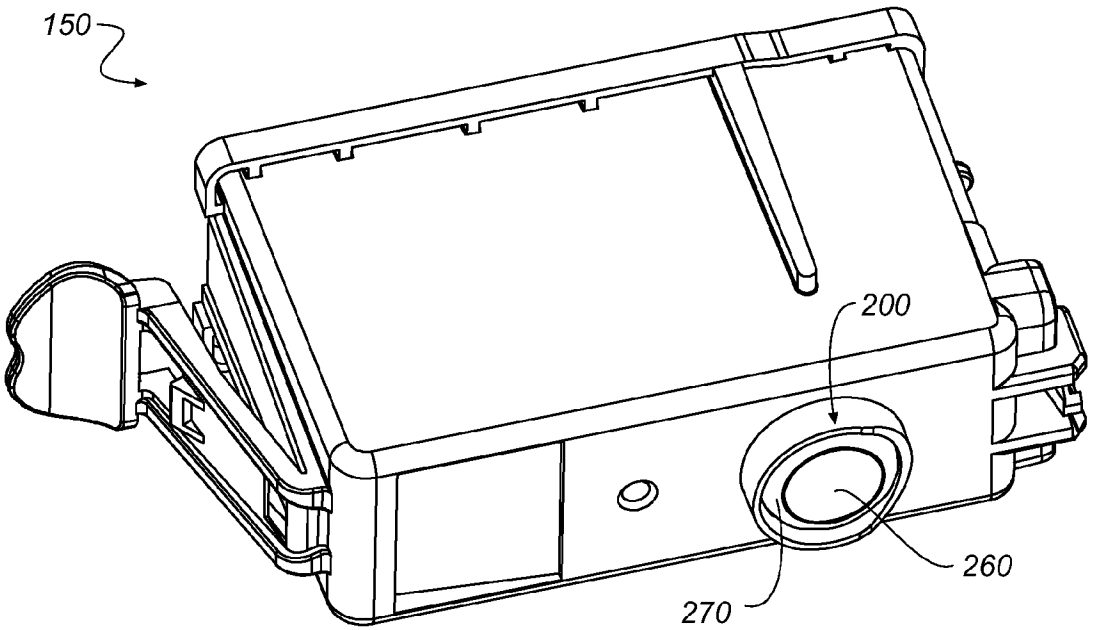
FIG. 3 is a perspective of the ink tank of the present invention having the components shown in their installed state.

Referring to FIG. 3, there is shown the filter 230 (not visible from this view), the wick 260 and single gasket 270 installed in the ink supply port 200. It can be seen that the design of the present invention is simple in that the parts are few in number and snugly arranged.

Figure 4:
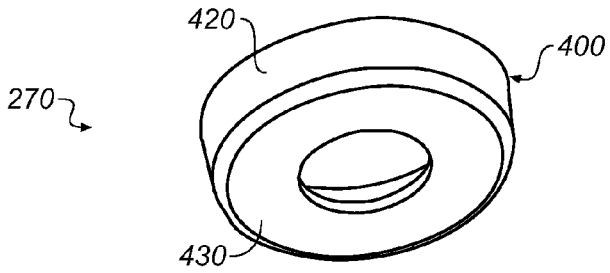
FIG. 4 is a perspective of an exterior portion of the single gasket of the present invention.
Figure 5:
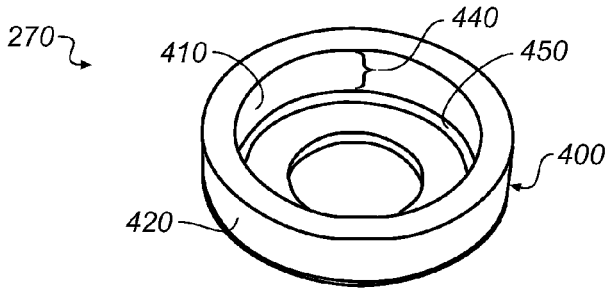
FIG. 5 is a perspective of an interior portion of the single gasket of the present invention.

Referring to FIGS. 4 and 5, there is shown the single gasket 270 according to one embodiment of the present invention. The single gasket 270 includes an annular-shaped body 400 having an inner surface 410 that defines an ink passageway and an outer surface 420 having a bottom portion 430 that abuts a portion of the printhead standpipe when installed in a printhead. More specifically, the bottom portion 430 extends into and over a portion of the passageway for forming a relatively large area for permitting it to seat and seal against the standpipe 810 (FIG. 8) more efficiently when installed. As best seen in FIG. 5, the inner surface 410 forms at one portion a substantially circular-shaped sleeve portion 440 as illustrated by the arrows, which is shaped to matingly receive the wick 260 (see FIG. 2). A tapered portion 450 extends between the sleeve portion 440 and the substantially flat bottom portion 430. The single gasket 270 functions to form an air-tight seal or substantially air-tight seal with the standpipe 810.

Figure 6:
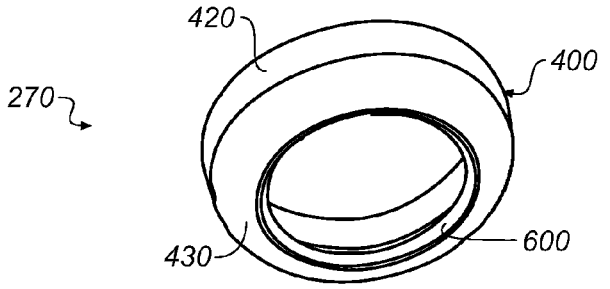
FIG. 6 is a perspective of an exterior portion of a second embodiment of the single gasket of the present invention.
Figure 7:
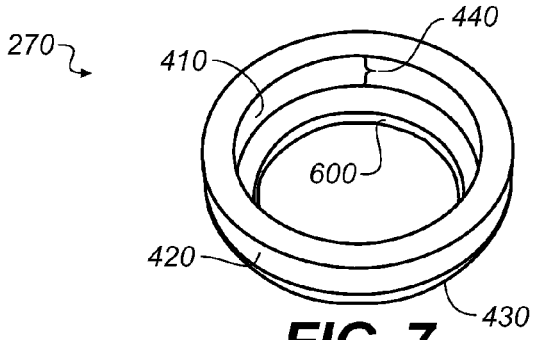
FIG. 7 is a perspective of an interior portion of the second embodiment of the single gasket of the present invention.

Referring to FIGS. 6 and 7, in a second embodiment of the single gasket 270, the single gasket 270 includes the same parts as the first embodiment except that: (1) the flat bottom portion 430 extends to lesser degree into the passageway as compared to the first embodiment so that a rim portion 600 fits over and around a top portion of the standpipe 810 when installed in the printhead; and (2) the bottom portion 430 is gradually tapered from the sleeve portion 440 to the rim portion 600 so that the tapered portion 450 of the first embodiment is not needed. As in the previous embodiment, the single gasket 270 functions to form an air-tight seal or substantially air-tight seal with the standpipe 810.

Figure 8:
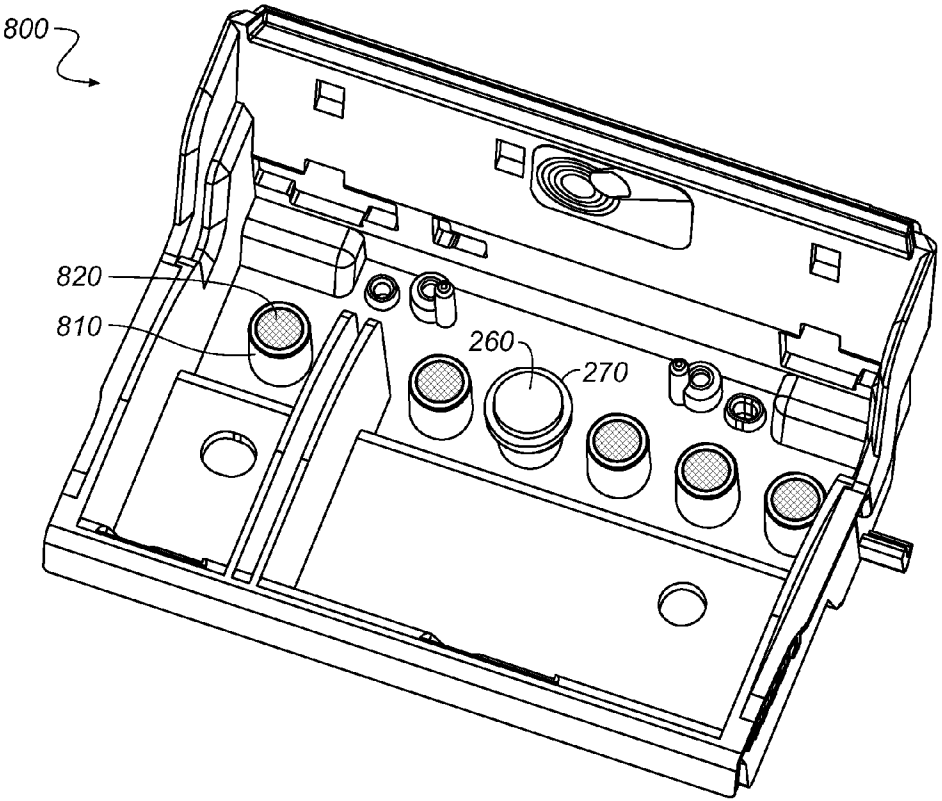
FIG. 8 is a perspective of a holding receptacle for the ink tank of the present invention having the ink tank removed for illustrating other components.

Referring to FIG. 8, a perspective of a printhead holding receptacle 800 for the free-ink ink tank 150 of the present invention is shown. The free-ink tank 150 is removed in FIG. 8 so that the interconnection of the standpipe 810 with the single gasket 270 and wick 260 is seen more clearly. It is also noted that preferably a standpipe filter 820 is disposed in each standpipe 810 in addition to the ink tank filter 230 that is disposed in ink supply port 200 of free ink tank 150 (FIG. 2).

Figure 9:
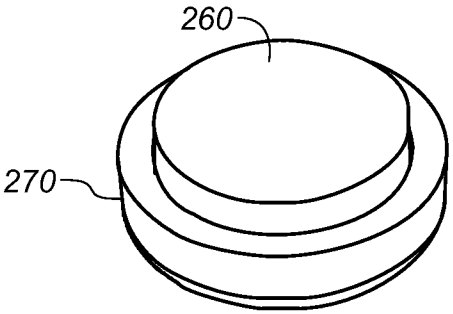
FIG. 9 is a perspective of the wick installed into the single gasket.

Referring to FIG. 9, there is shown a perspective of the wick 260 installed in the single gasket 270. This illustrates the wick 260 fitting conformingly into the sleeve portion 440 of the single gasket 270 for preventing air leakage into the free-ink tank 150.

Figure 10:
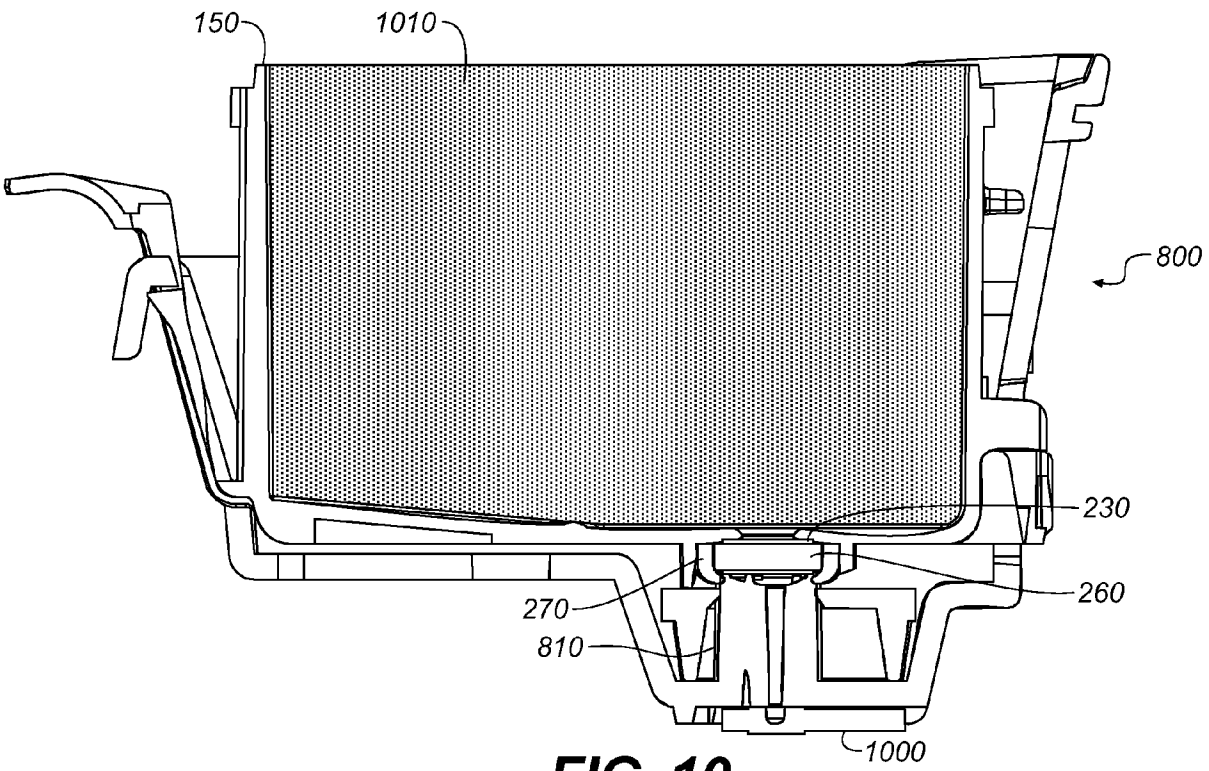
FIG. 10 is a side section view in cross section of the ink tank of the present invention.

Referring to FIG. 10, there is shown a side view of the free-ink tank 150 of the present invention installed in the printhead holding receptacle 800. In this view, the rim portion 600 of the single gasket 270 is disposed over and around a top portion of the standpipe 810, which is the embodiment of the single gasket 270 shown in FIGS. 6 and 7. In the single gasket embodiment of FIGS. 4 and 5, the single gasket 270 would seat firmly against a top portion of the standpipe 810 as opposed to over and around as in FIG. 10. The wick 260 is disposed on the single gasket 270 and the filter 230 is disposed on the single gasket 270. A printhead die 1000 is disposed on a bottom portion of the printhead holding receptacle 800 for permitting ink 1010 in the free-ink tank 150 to be dispensed downstream through the filter 230 and the wick 260, into the standpipe 810 and eventually ejected by the printhead die 1000 onto a recording medium 115 (see FIG. 1).

The invention has been described in detail with particular reference to certain preferred embodiments thereof, but it will be understood that variations and modifications can be effected within the spirit and scope of the invention.

PARTS LIST

100 off-axis printer
103 Eric
105 inkjet printhead
110 carriage
115 recording medium
120 primary ink supply
125 support base
130 print region
145 tubing connector
150 secondary ink supply or free-ink tank
155 conduit
158 free-ink chamber
160 flexible tubing
165 pressure regulator
200 ink supply port
210 free-ink chamber end
220 outlet end
230 filter
240 first surface
250 second surface
260 wick
270 single gasket
400 annular-shaped body
410 inner surface
420 outer surface
430 bottom portion
440 sleeve portion
450 tapered portion
600 rim portion
800 holding receptacle
810 standpipe
820 filter
1000 printhead die
1010 ink

The invention claimed is:

1. An ink tank comprising:
a free-ink chamber;
an ink supply port extending from the free-ink chamber, which ink supply port permits passage of ink from the free-ink chamber;
a filter disposed in the ink supply port and having a first surface facing the free-ink chamber and a second surface opposite the first surface;
a wick disposed in the ink supply port adjacent to the second surface of the filter and downstream of the filter; and
a single gasket disposed in the ink supply port adjacent to and downstream of the wick; wherein the single gasket includes a sleeve having an inner surface and the wick fits inside and within the inner surface of the sleeve.

2. The ink tank as in claim 1, wherein the filter is a porous material permitting ink to flow through.

3. The ink tank as in claim 2, wherein the filter is stainless steel having a plurality of holes.

4. The ink tank as in claim 1, wherein the single gasket includes an annular-shaped body having an inner surface that defines a passageway for ink; wherein a portion of the inner surface engages at least a portion of a printhead standpipe when installed in a printhead.

5. The ink tank as in claim 1, wherein the single gasket includes a single gasket annular-shaped body having an inner surface that defines a hole for an ink passageway and an outer surface; wherein the outer surface abuts a portion of the printhead conduit when installed in a printhead.

6. The ink tank as in claim 1, wherein the single gasket includes a bottom portion for sealing to a standpipe.

7. The ink tank as in claim 1, wherein the inner surface of the sleeve is circular shaped and the wick includes a conforming shape for permitting the wick to rest inside and within the inner surface of the sleeve.

8. The ink tank as in claim 1, wherein the wick is a single wick.

9. The inkjet printer as in claim 1, wherein the single gasket includes a bottom portion for sealing to a standpipe.

10. An inkjet printer comprising:
a printhead including a holding receptacle having a standpipe for receiving ink;
a carriage for moving the printhead across a print region;
a primary ink supply mounted on a support base of the printer;
a secondary ink supply mounted in the holding receptacle of the printhead, the secondary ink supply including:
a free-ink chamber;

an ink supply port extending from a tank body, which ink supply port permits passage of ink from the free-ink chamber to the standpipe in the holding receptacle of the printhead;

a filter disposed in the ink supply port and having a first surface facing the free-ink chamber and a second surface opposite the first surface;

a wick disposed in the ink supply port adjacent to the second surface of the filter and downstream of the filter; and a single gasket disposed in the ink supply port adjacent to and downstream of the wick, wherein the single gasket seals against the standpipe and includes a sleeve having an inner surface and the wick fits inside and within the inner surface of the sleeve.

11. The inkjet printer as in claim 10, wherein the inner surface of the sleeve is circular shaped and the wick includes a conforming shape for permitting the wick to rest inside and within the inner surface of the sleeve.

12. The inkjet printer as in claim 10, wherein the wick is a single wick.

13. The inkjet printer as in claim 10, wherein the filter is a porous material permitting ink to flow through.

14. The inkjet printer tank as in claim 10, wherein the filter is stainless steel having a plurality of holes.

15. The inkjet printer as in claim 10, wherein the single gasket includes an annular-shaped body having an inner surface that defines a passageway for ink; wherein a portion of the inner surface engages at least a portion of a printhead standpipe when installed in a printhead.

16. The inkjet printer as in claim 10, wherein the single gasket includes a single gasket annular-shaped body having an inner surface that defines a hole for an ink passageway and an outer surface; wherein the outer surface abuts a portion of the printhead conduit when installed in a printhead.

* * * * *